US007549948B2

(12) United States Patent
Makofsky

(10) Patent No.: US 7,549,948 B2
(45) Date of Patent: Jun. 23, 2009

(54) POSTURAL SUPPORT AND EXERCISE JACKET

(76) Inventor: Howard W. Makofsky, 89 Lincoln Ave., Mastic Beach, NY (US) 11951

( * ) Notice: Subject to any disclaimer, the term of this patent is extended or adjusted under 35 U.S.C. 154(b) by 57 days.

(21) Appl. No.: 11/400,653

(22) Filed: Apr. 7, 2006

(65) Prior Publication Data

US 2007/0238591 A1 Oct. 11, 2007

Related U.S. Application Data

(60) Provisional application No. 60/630,642, filed on May 25, 2005.

(51) Int. Cl.
*A63B 21/00* (2006.01)
*A41D 13/00* (2006.01)

(52) U.S. Cl. ..... 482/92; 2/69

(58) Field of Classification Search ..... 482/74, 482/121–126, 69

See application file for complete search history.

(56) References Cited

U.S. PATENT DOCUMENTS 4,961,573 A * 10/1990 Wehrell ..... 482/74
5,080,191 A * 1/1992 Sanchez ..... 182/3
5,433,688 A * 7/1995 Davies ..... 482/124
5,803,881 A * 9/1998 Miller ..... 482/124
5,993,362 A * 11/1999 Ghobadi ..... 482/124
6,338,699 B1 * 1/2002 Veitch ..... 482/69
6,361,478 B1 * 3/2002 Giancaspro ..... 482/69
6,520,290 B1 * 2/2003 Carter ..... 182/36
6,651,594 B1 * 11/2003 Bagwell ..... 119/770
6,658,666 B2 * 12/2003 Schweer ..... 2/94
6,659,921 B2 * 12/2003 Vernon ..... 482/124
7,036,628 B2 * 5/2006 Wilcox et al. ..... 182/9
D525,364 S 7/2006 Burgueno et al.
7,086,091 B2 * 8/2006 Jordan ..... 2/69
2004/0128734 A1 * 7/2004 Jordan ..... 2/69

* cited by examiner

*Primary Examiner*—Fenn C Mathew
(74) *Attorney, Agent, or Firm*—Galgano & Associates, PLLC

(57) ABSTRACT

A postural support and exercise jacket according to the invention includes a pair of shoulder straps coupled to a waist strap which extends around the back of the user and terminates at the sides of the user. A pair of adjustable handles are coupled to opposite ends of the waist strap. The user dons the jacket by slipping arms through the respective shoulder straps and adjusts the handles according to arm length. With the jacket in place, several different exercises can be performed. Optional presser balls are provided and are adjustably coupled to the shoulder straps to overlie a muscle "knot".

25 Claims, 12 Drawing Sheets

POSTURAL SUPPORT AND EXERCISE JACKET

This application claims the benefit of U.S. Provisional Application No. 60/630,642 filed May 25, 2005.

BACKGROUND OF THE INVENTION

1. Field of the Invention

This invention relates broadly to postural supports and correction devices. More particularly, this invention relates to a posture correction device which incorporates an active exercise component into a postural support system.

2. Brief Description of the Prior Art

Forward head/rounded shoulders posture is a common postural imbalance that is caused by aging, trauma, occupational factors, osteoporosis, emotional stress, as well as other causes. This imbalance is characterized by extension or backward bending of the head, flexion or forward bending of the neck/upper back, and rounding of the shoulders.

Forward head posture (FHP) causes the head to shift anteriorly beyond its normal axis. This posture may alter the neuromuscular influences on the entire masticatory (chewing) system, thus influencing the resting position of the mandible (lower jaw bone). FHP has an immediate effect on mandibular closure.

In FHP, the supramandibular muscles (muscles above the lower jaw) may pull the mandible toward the maxilla (upper-jaw bone) and cause a decrease in the resting freeway space. This can also cause the front teeth to be slated lingually (toward the back of the mouth). FHP causes the suprahyoid and posterior cervical musculature to shorten isometrically, while the infrahyoid muscles are stretched. This also decreases or eliminates freeway space. The effects of this abnormal position may lead to an excessive amount of tension in the muscles of mastication and the supporting structures. Clinically, patients with FHP are at a greater risk of developing swallowing impairment and lower extremity problems such as shin splints, ankle sprains, and patellofemoral pain.

FHP is also related to temporomandibular joint disorder (TMD or TMJ) which manifests itself as pain and hypertonicity in the muscles of mastication and in the muscles of the head-neck-jaw complex as demonstrated by increased electromyographic activity.

The combination of FHP and TMD can reduce vital lung capacity by as much as 30%. Endorphin production is reduced and the large intestine is affected. Headaches and facial pain also result.

TMD and FHP are treated by physical therapy including various exercises as well as the application of various topical stimulants such as heat, ultrasound, massage, etc.

My prior U.S. Pat. No. 6,939,269 discloses an exercise device for improving head, neck, and spinal alignment. The device includes a bracket having a pair of spaced apart pulleys and a U-shaped base which is adapted to fit over a door, a rope having at least one hand grip attached to one end and a coupler attached to the other end, and a head harness having at least one coupler for mating with the coupler on the rope. The apparatus is used by coupling the bracket to a door, attaching the harness to the user's head and coupling the rope to the harness. From either a standing or sitting position, the user pulls on the hand grip(s) to effect a lifting of the harness. The location of the pulleys is adjustable to suit the user and the harness is provided with both front and rear couplers. The device provides for the passive stretching of the posterior cervical/suboccipital muscles, the active assisted exercise of the deep neck flexor muscles, the resistive exercise of the deep neck flexors including isotonic, isokinetic, and isometric exercises, as well as the resistive exercise of the mid/lower trapezius and rhomboid muscles.

Since developing the apparatus disclosed in the '269 patent, I have discovered that additional active exercises are useful in correcting FHP.

SUMMARY OF THE INVENTION

It is therefore an object of the invention to provide a postural support and exercise device.

It is another object of the invention to provide an apparatus for the active stretching of tight postural muscles.

It is a further object of the invention to provide an apparatus for the active strengthening of weak phasic muscles.

It is also an object of the invention to provide an apparatus for posture correction.

It is an additional object of the invention to provide an apparatus for self-mobilization of the cervical and thoracic spine.

It is still another object of the invention to provide an apparatus for myofascial release.

It is another object of the invention to provide an apparatus for core strengthening.

It is a further object of the invention to provide an apparatus for trunk support.

In accord with these objects, which will be discussed in detail below, a postural support and exercise jacket according to the invention includes a pair of shoulder straps coupled to a waist strap which extends around the back of the user and terminates at the sides of the user. A pair of adjustable handles are coupled to opposite ends of the waist strap. The user dons the jacket by slipping arms through the respective shoulder straps and adjusts the handles according to arm length. With the jacket in place, several different exercises can be performed. Optional presser balls are provided and are adjustably coupled to the shoulder straps to overlie a muscle "knot".

Certain of the foregoing and related objects are readily attained according to the invention by the provision of a postural support and exercise jacket, comprising a pair of should straps each having two ends; a waist strap having two ends, both ends of each shoulder strap being coupled to said waist strap; and a pair of depending handles, each being coupled to said waist strap. Preferably, means are provided for adjusting said handles as to their distance from said waist strap.

Advantageously, said shoulder straps cross over each other and are coupled to each other at the point where they cross over. Desirably, said handles are connected to opposite ends of said waist strap. Preferably, a pair of depending straps are coupled to said waist strap and said handles are each coupled to one of said depending straps.

In a preferred embodiment, said depending straps form lower loops and said means for adjusting includes a pair of ropes and each handle is coupled to a depending strap by one of said pair of ropes. Desirably, each handle includes a gripping part and two opposite eyelets, each rope has two ends, each end extending through an eyelet and being knotted. Most advantageously, each handle includes a gripping part and two opposite eyelets, one of said eyelets having an orthogonal threaded bore with a set screw. Each rope extends through a respective eyelet and is captured by said set screw. In a particularly preferred embodiment, a postural support and exercise jacket embodying the present invention comprises a waist strap having a first and second end; a pair of shoulder straps having first and second ends each coupled to said waist strap; a pair of depending straps, each coupled to said waist strap; and a pair of handles, each adjustably coupled to one of said depending straps in a manner whereby the distance of the handles from the waist strap can be adjusted.

In a preferred embodiment, at least one ball is removably attached to one of said shoulder straps. Most advantageously, a pair of balls are provided and each ball is removably coupled to a respective shoulder strap. Each ball is advantageously movable over at least a portion of a respective shoulder strap and, most desirably, each ball has a throughbore with a strap extending therethrough.

Proper use of the jacket according to the invention provides decreased muscle tension in the neck, jaw, shoulders, and back, diminished discomfort (including stiffness, tightness, numbness, burning, headaches, jaw pain and dysfunction, etc.), improved postural alignment that is efficient, functional, and aesthetic, enhanced core stability for the relief of low back pain, increased back extensor muscle strength, decreased fatigue and improved mental state, enhanced performance in work, athletics, dance, etc.

Additional objects and advantages of the invention will become apparent to those skilled in the art upon reference to the detailed description taken in conjunction with the provided figures.

DETAILED DESCRIPTION

Figure 1:
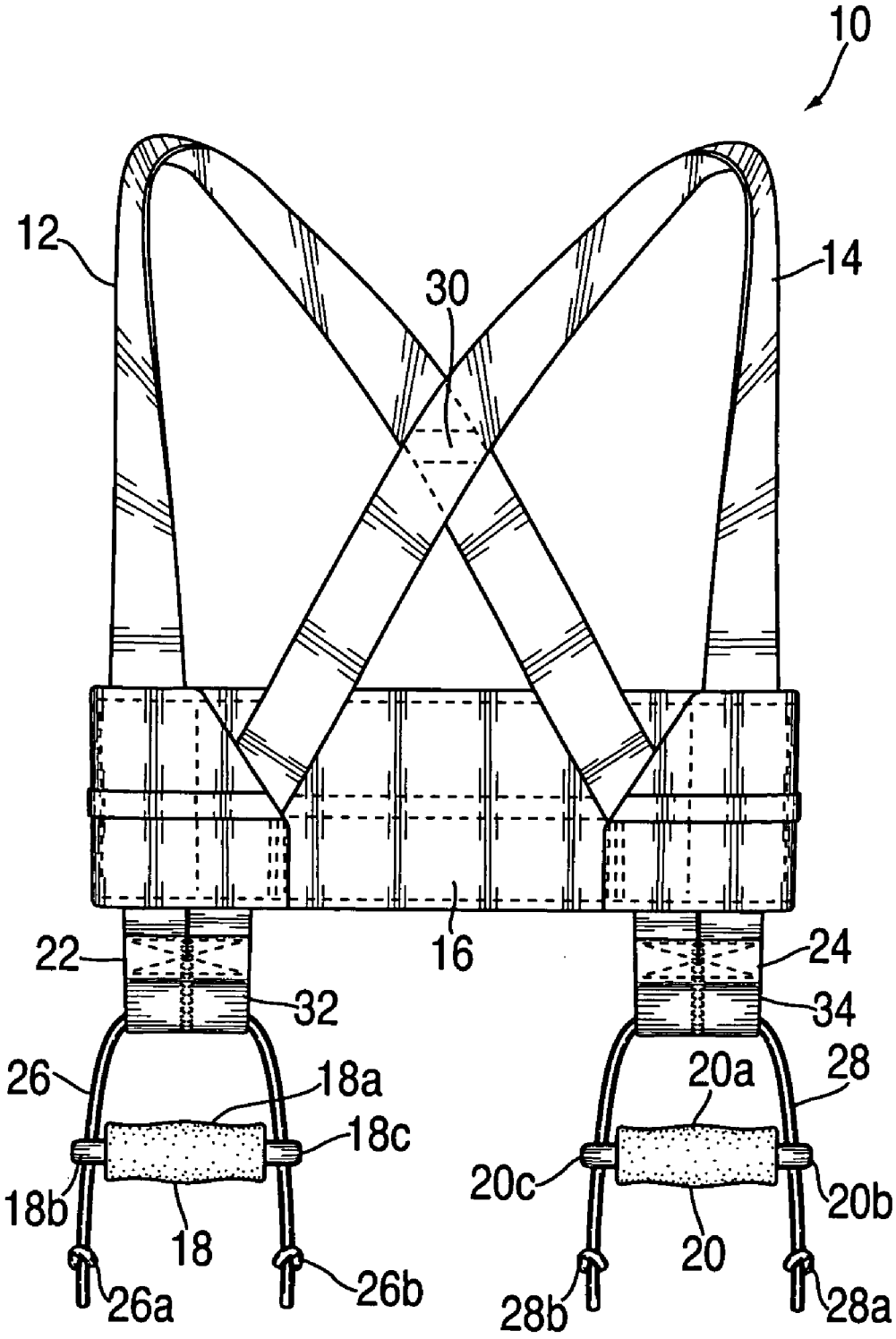
FIG. 1 is a front elevation view of a postural support and exercise jacket according to the invention.
Figure 1A:
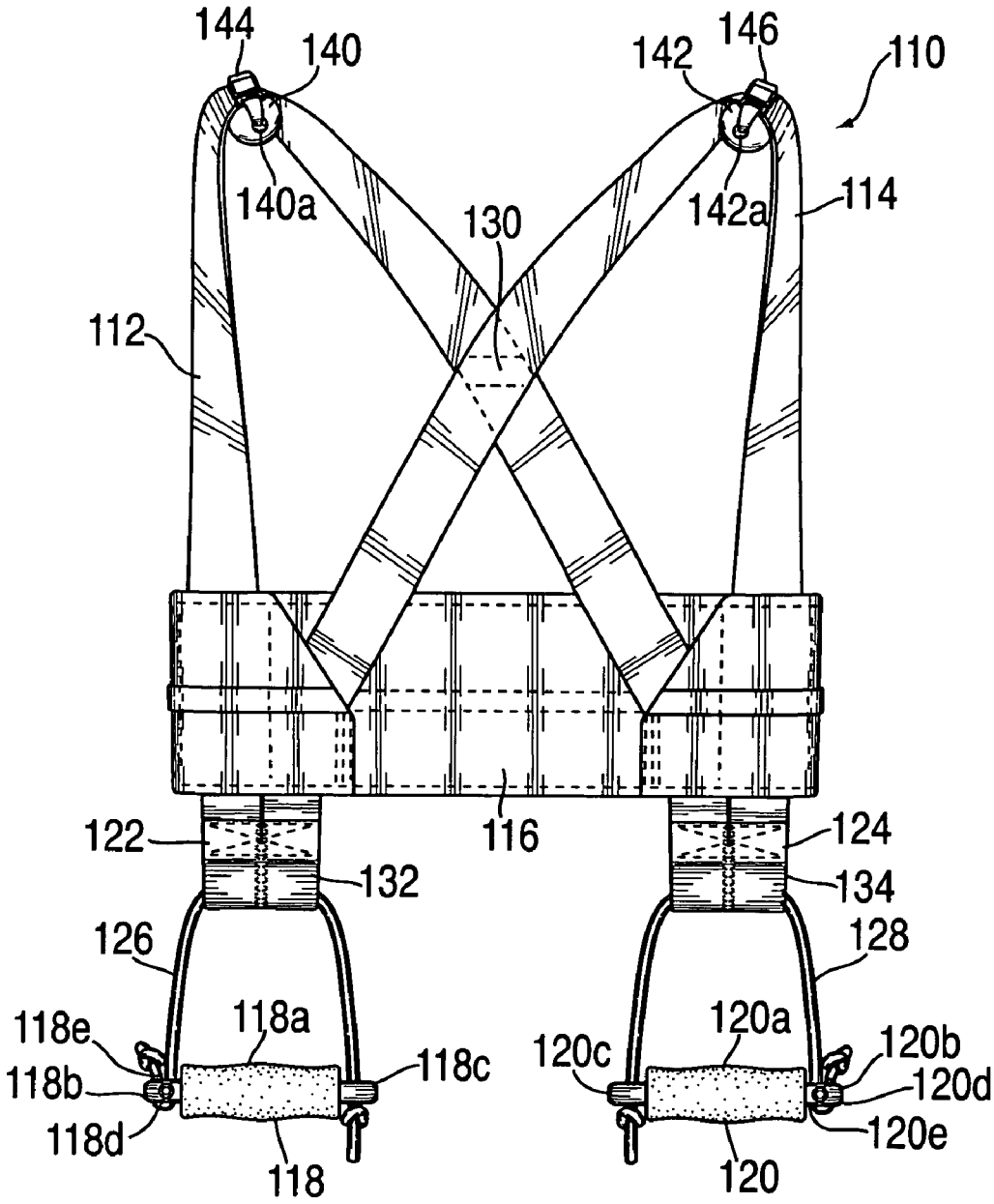
FIG. 1A is a view similar to FIG. 1 but showing the optional presser balls attached to the shoulder straps and illustrating a different type of handle adjustment.
Figure 4:
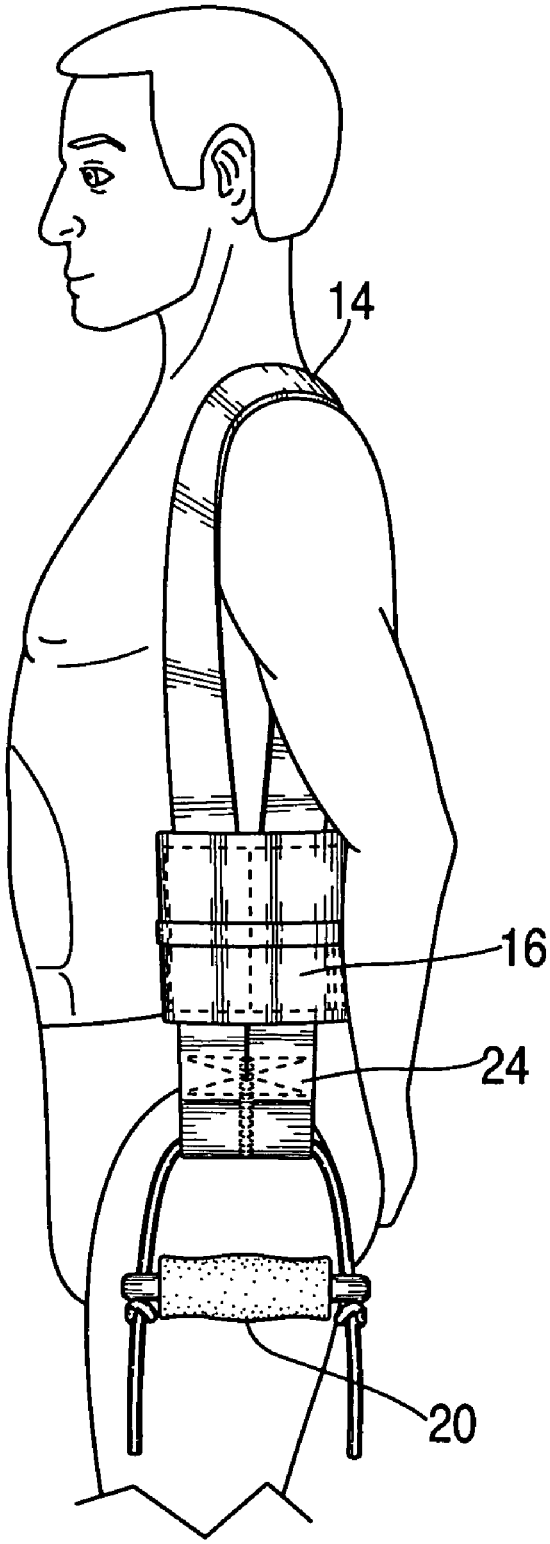
FIG. 4 is a side elevation view of a user wearing the jacket of FIGS. 1 and 2 without gripping the handles.
Figure 4A:
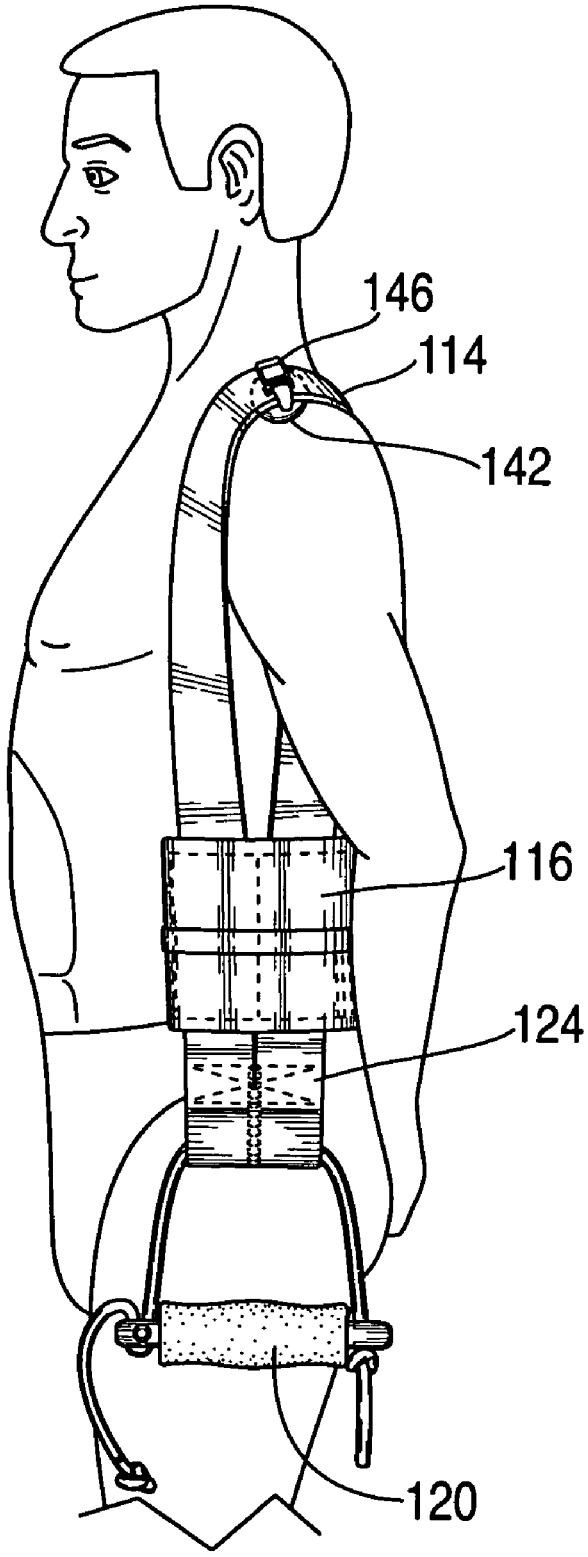
FIG. 4A is a view similar to FIG. 4 but illustrating the jacket of FIGS. 1A and 2A.
Figure 5:
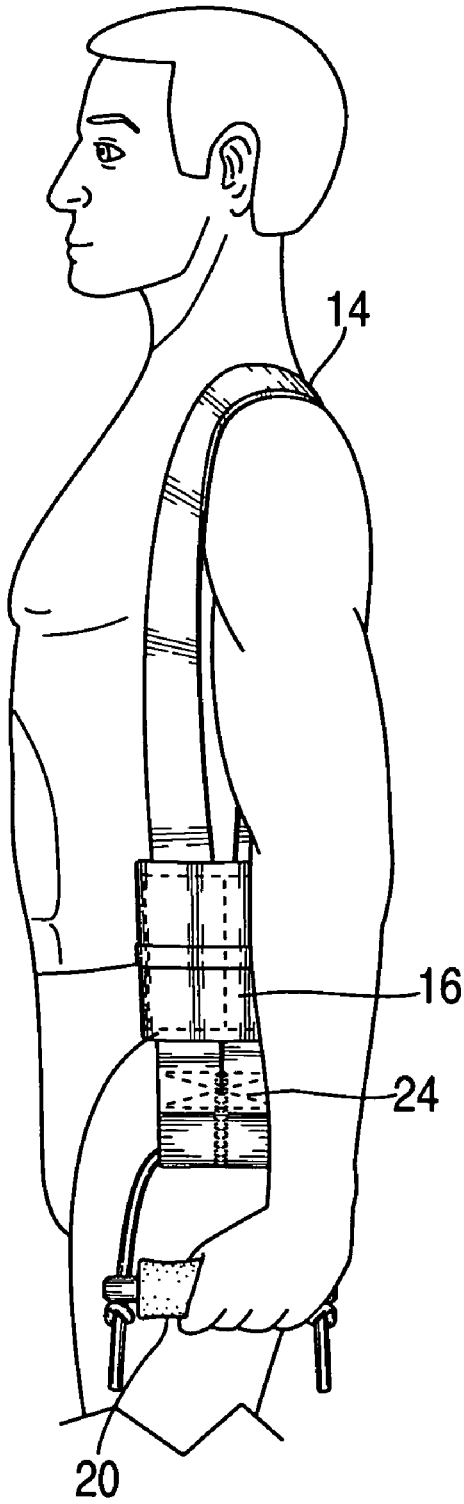
FIG. 5 is a side elevation view of a user wearing the jacket of FIGS. 1 and 2 and gripping the handles.
Figure 5A:
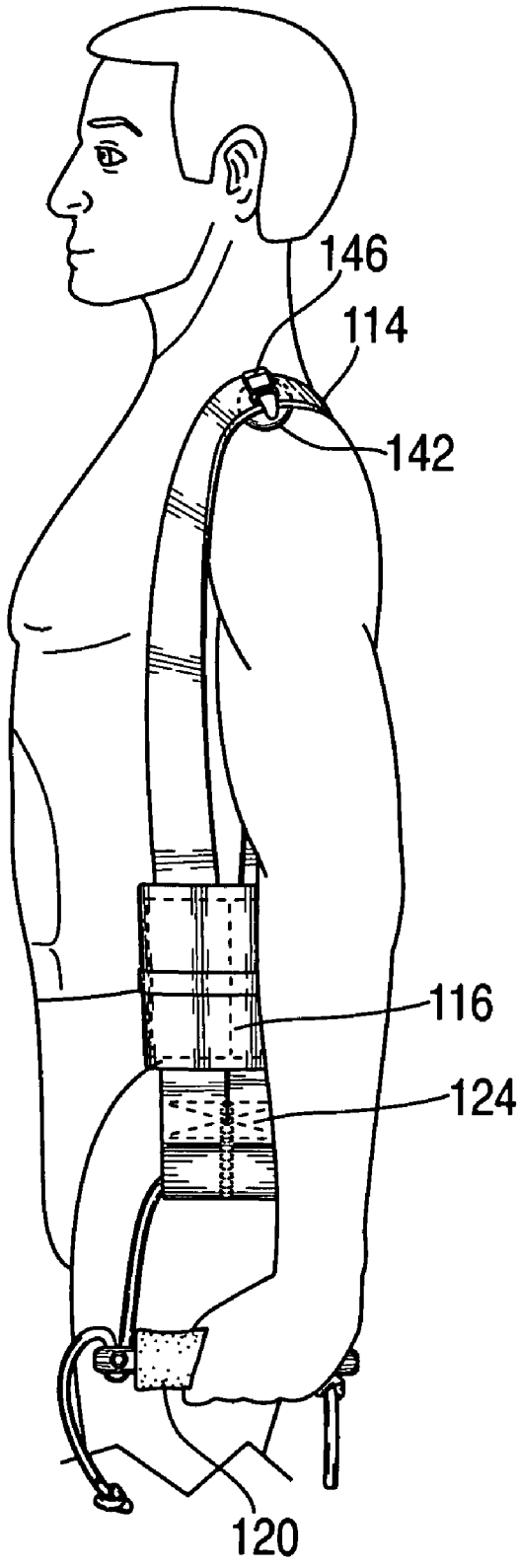
FIG. 5A is a view similar to FIG. 4 but illustrating the jacket of FIGS. 1A and 2A.
Figure 6:
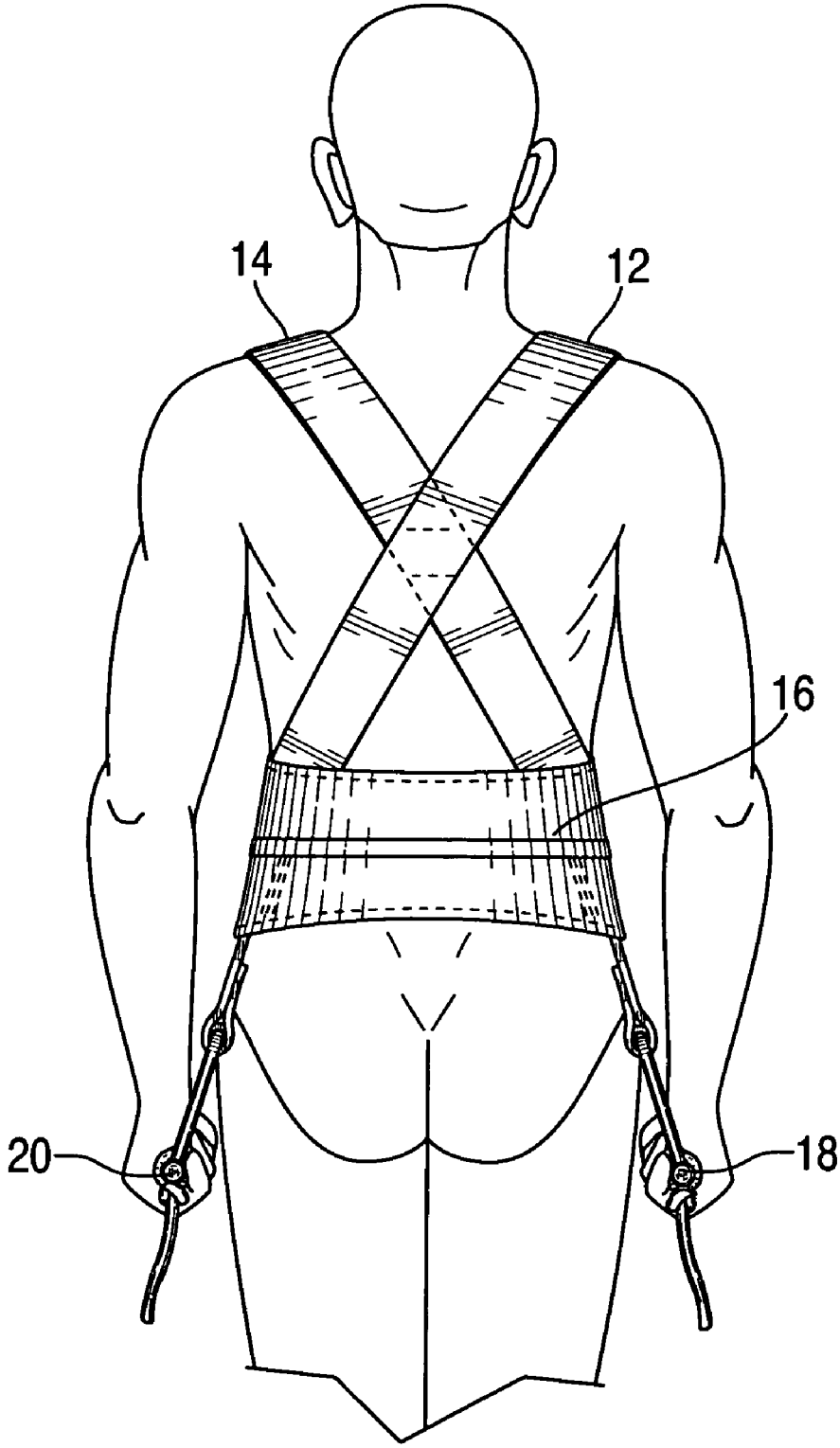
FIG. 6 is a rear elevation view of a user wearing the jacket of FIGS. 1 and 2 and gripping the handles.
Figure 6A:
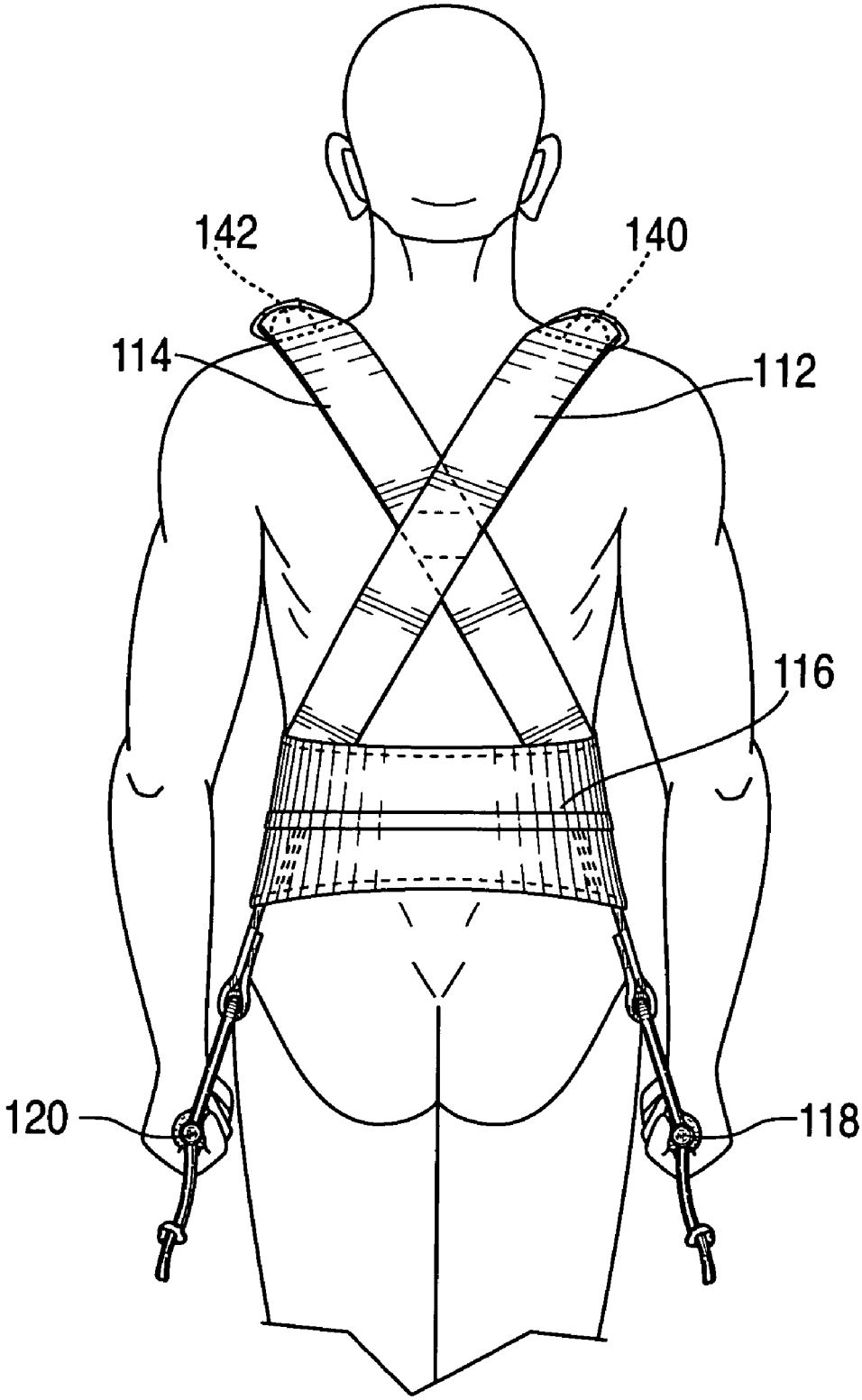
FIG. 6A is a rear elevation view of a user wearing the jacket of FIGS. 1A and 2A and gripping the handles.

Turning now to FIGS. 1-6, a postural support and exercise jacket 10 according to the invention includes a pair of shoulder straps 12, 14 coupled to a waist strap 16 Which extends around the back of the user 1 and terminates at the sides of the user 1 as seen best in FIGS. 4 and 6. A pair of adjustable handles 18, 20 are coupled to opposite ends of the waist strap 16 via downward depending straps 22, 24 and ropes 26, 28. As illustrated, the shoulder straps 12, 14 cross over each other on the back of the user as seen best in FIG. 6 and are coupled to each other at their intersection 30. The depending straps 22, 24 form lower loops 32, 34 through which the ropes 26, 28 extend. The handles 18, 20 each have a grip part 18*a*, 20*a* and two opposite eyelets 18*b*, 18*c*, 20*b*, 20*c*. The ropes 26, 28 pass through the eyelets 18*b*, 18*c*, 20*b*, 20*c* as illustrated in FIG. 1, for example, and knots 26*a*, 26*b*, 28*a*, 28*b* are made at the ends of the ropes. The knots capture the handles by not passing through the eyelets. As can be seen from comparing FIGS. 1 and 2 with FIGS. 3-6, the knots 26*a*, 26*b*, 28*a*, 28*b* can be untied and moved to adjust the vertical location of the handles 18, 20.

The jacket 10 is preferably made of leather, canvas, or any other durable fabric which can withstand a substantial amount of stretching force (typically about 5-50 lbs. of downward force). The jacket may be assembled by stitching together fabric pieces as shown, e.g., by the dotted lines in FIGS. 1, 2, 4, 5, and 6. The ropes may be made of natural or synthetic fiber. The handles 18, 20 may be made of natural or synthetic materials including wood, plastic, metal, or a combination of materials. The grip part 18*a*, 20*a* is preferably covered with a soft, preferably resilient material such as a foam plastic material.

Referring now to FIGS. 3-6, the user 1 dons the jacket 10 by slipping arms through the respective shoulder straps 12, 14 and adjusts the handles 18, 20 according to arm length by moving the knots 26*a*, 26*b*, 28*a*, 28*b*. With the jacket in place, several different exercises can be performed in a standing, sitting or prone position.

EXAMPLE 1

The "Posture Pump" Exercise

To begin, the standing user assumes comfortable but straight head, neck, spinal, and shoulder girdle alignment. The user then alternates between the rest position and posture over-correction, which consists of pushing the handles down and slightly back (towards the heels). This motion involves depression and retraction of shoulder girdle without protruding the shoulders forward at the glenohumeral (shoulder) joints and without arching the lower back (avoid hyperlordosis). In order to achieve the desired downward motion of the shoulders, it is necessary to retract them slightly backward. In addition, the jacket makes the user stand taller. Consequently, as the shoulder girdle is moving down and slightly back, the user should simultaneously attempt to raise the spinal column in an upward direction without arching the lower back. The proximal end of the clavicles at the sternoclavicular joints should move up as the distal end of the clavicles at the acromioclavicular joints moves down. The net effect of this is a "leveling" of the clavicles (i.e., as posture is corrected, the clavicles should become parallel with the ground).

To enhance upper limb mechanical advantage, the user can simultaneously rise up on the toes of both feet while the pushing down on the handles. This will enable the user to achieve additional lowering of the shoulders. However, for people with impaired standing balance or ankle strength, the toe-raising enhancement should not be attempted.

The suggested length of time the shoulders are to be held in the depressed (down and towards the heels) position is approximately 5 seconds. However, this can be longer based upon user preference. In addition to the standing position, The "Posture Pump" exercise can be performed in the sitting or supine position.

EXAMPLE 2

The "Chin-Tuck/Neck Retraction" Exercise

This exercise is performed similarly to the "Posture Pump" with the addition of a chin-tuck/neck retraction motion of the head-neck in conjunction with shoulder girdle depression. The most effective way of performing the "Chin-Thck/Neck Retraction" exercise is to coordinate it with the "Posture-Pump" such that the two movements are performed simultaneously and rhythmically. To facilitate the lower trapezius muscles, external rotation of the shoulders is added to shoulder girdle depression/retraction.

The suggested length of time for the hold at end-range is 5 seconds. However, this can be modified to speed it up or slow it down based upon user preference.

EXAMPLE 3

The "Neck Rotation" Exercise

To begin, the user assumes the posture over correction position (i.e., shoulder depression with a gentle chin-tuck/neck retraction) by pushing the handles down and slightly back (toward the user's heels).

Once in this position, the user turns his or her head and neck slowly to the right.

Following a slow return of the head and neck to the center, the user repeats head and neck rotation to the left while maintaining a down and slightly back pushing force on the handles.

This cycle is preferably repeated 5 times.

EXAMPLE 4

The "Neck Muscle Stretch" Exercise

The jacket according to the invention provides the stability necessary to properly stretch various muscles in the head-neck region. Each of the following stretches is taken to the point of initial resistance and held anywhere from 5 to 30 seconds. At no time should painful or other uncomfortable symptoms such as dizziness or numbness be perceived during the stretch. The only acceptable sensation is that of a mild stretch. Each stretch should be repeated 3 times.

EXAMPLE 4a

Upper Trapezius Stretch

Tilt the head and neck to the left and then repeat to the right, i.e, ear to shoulder.

EXAMPLE 4b

Sternocleidomastoid Stretch

Tilt the head and neck to the left while rotating to the right. Then perform a chin-tuck maneuver. Repeat this combination to the other side (tilt right, rotate left, and chin-tuck).

EXAMPLE 4c

Anterior/Middle Scalenes

Tilt the head-neck to the left while rotating right. Repeat in reverse to stretch the left side.

EXAMPLE 4d

Posterior Scalene/Levator Scapulae

Tilt and rotate the head to the left while flexing the head-neck down and to the left (nose to the left hip). Reverse directions and look down and to the right hip in order to stretch the left side.

To enhance any of the above neck stretches (Examples 4a-4b), additional pressure can be applied to the side handle on the side of the stretch. This will in effect stretch the desired muscle(s) from below up.

EXAMPLE 5

The "Turtle-Neck" Exercise

Not unlike turtles, humans "lose" their necks when suffering stress. As shoulders work their way up and the head tilts abnormally back and down, the neck becomes increasingly short and pushed forward. The objective of the "Turtle-Neck" exercise is to restore length and vertical alignment to the neck. This is analogous to the turtle's neck emerging from its shell and is achieved by pushing down through the side handles while simultaneously stretching the neck in an upwards direction. There is no universal way of achieving the desired outcome. Each individual works toward a longer and more vertical neck in his or her own way. It may involve stretching the front, back, and sides of the neck. It may also involve rhythmically working the shoulders in a downward direction while simultaneously working the neck upwards. Even though it feels good, the user should be careful not to over stretch.

EXAMPLE 6

The "Posture Walk" Exercise

In addition to a combination of stretching and strengthening exercises, posture retraining involves complex sensorimotor learning processes. In order for poor postural habits to be exchanged for posture that is more vertical, efficient, and balanced, a person's kinesthetic awareness in a variety of positions must be improved. This is why it is useful to perform the jacket exercises not only in the standing position, but also in sitting and lying as well.

The objective of the "Posture Walk" exercise is to retrain optimal postural alignment while the user ambulates. As a result of this dynamic approach to postural realignment, users will experience enhanced postural awareness in all positions and while engaged in a variety of activities (e.g., walking, jogging, sports, dance, etc). exercises 1 and 2 as described above or with modifications, can be easily performed while walking. To enhance overall relaxation during the walk, be creative. A "Posture Walk" on the beach, while enjoying a nice sunset, can only help.

Figure 2:
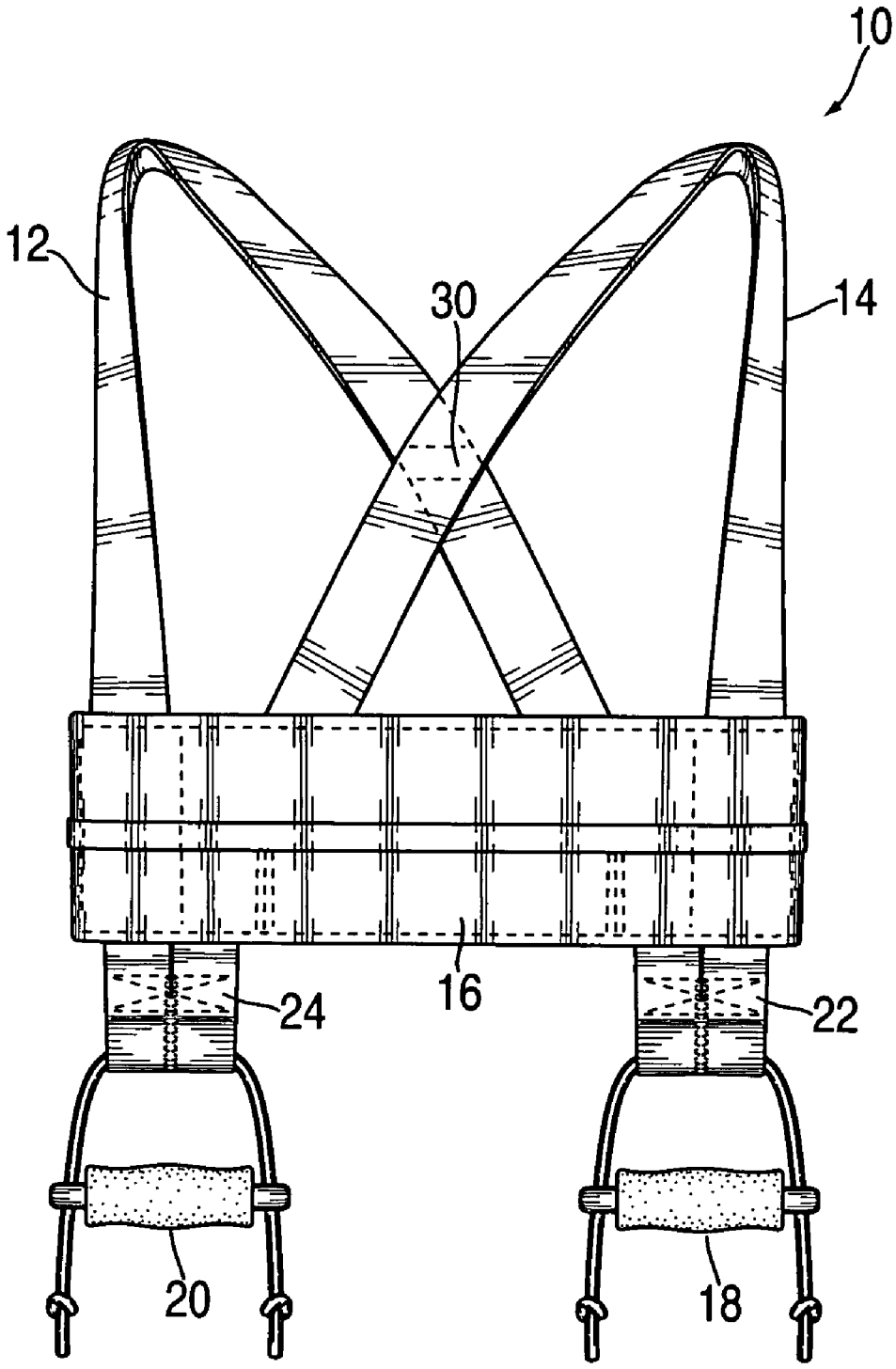
FIG. 2 is a rear elevation view of a postural support and exercise jacket according to the invention.
Figure 2A:
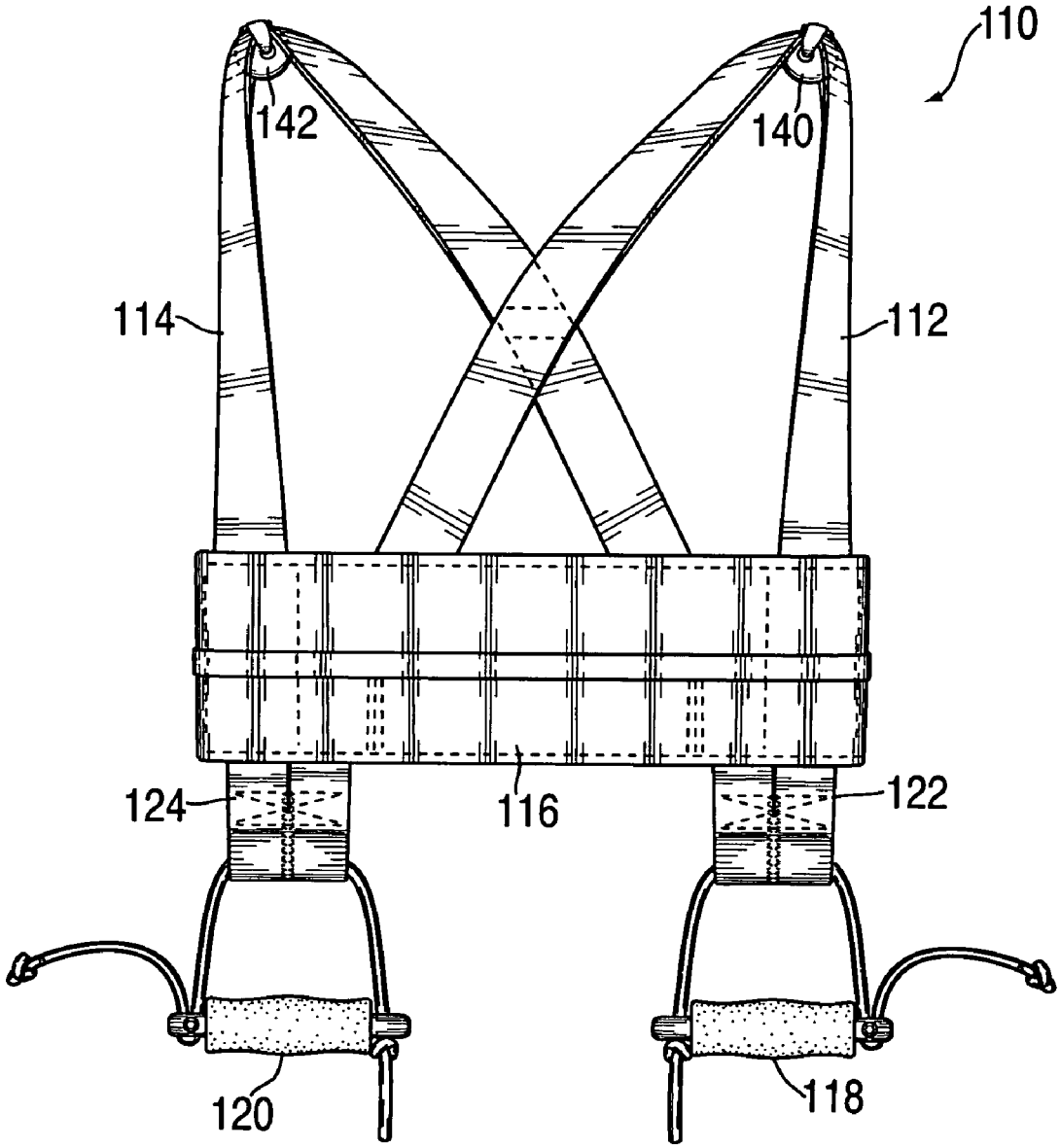
FIG. 2A is a view similar to FIG. 2 but showing the optional presser balls attached to the shoulder straps and illustrating a different type of handle adjustment.
Figure 3:
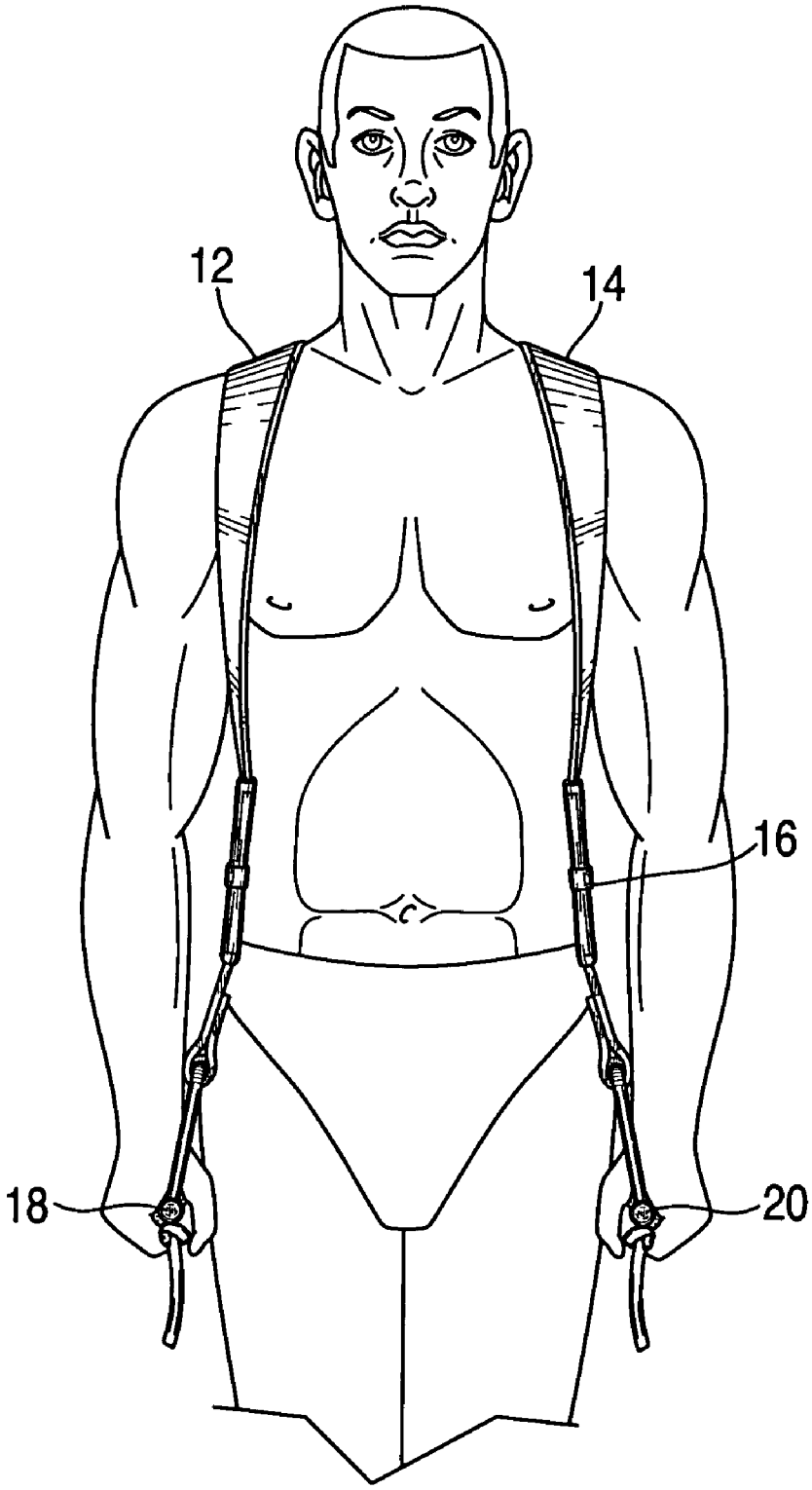
FIG. 3 is a front elevation view of a user wearing the jacket of FIGS. 1 and 2 and gripping the handles.
Figure 3A:
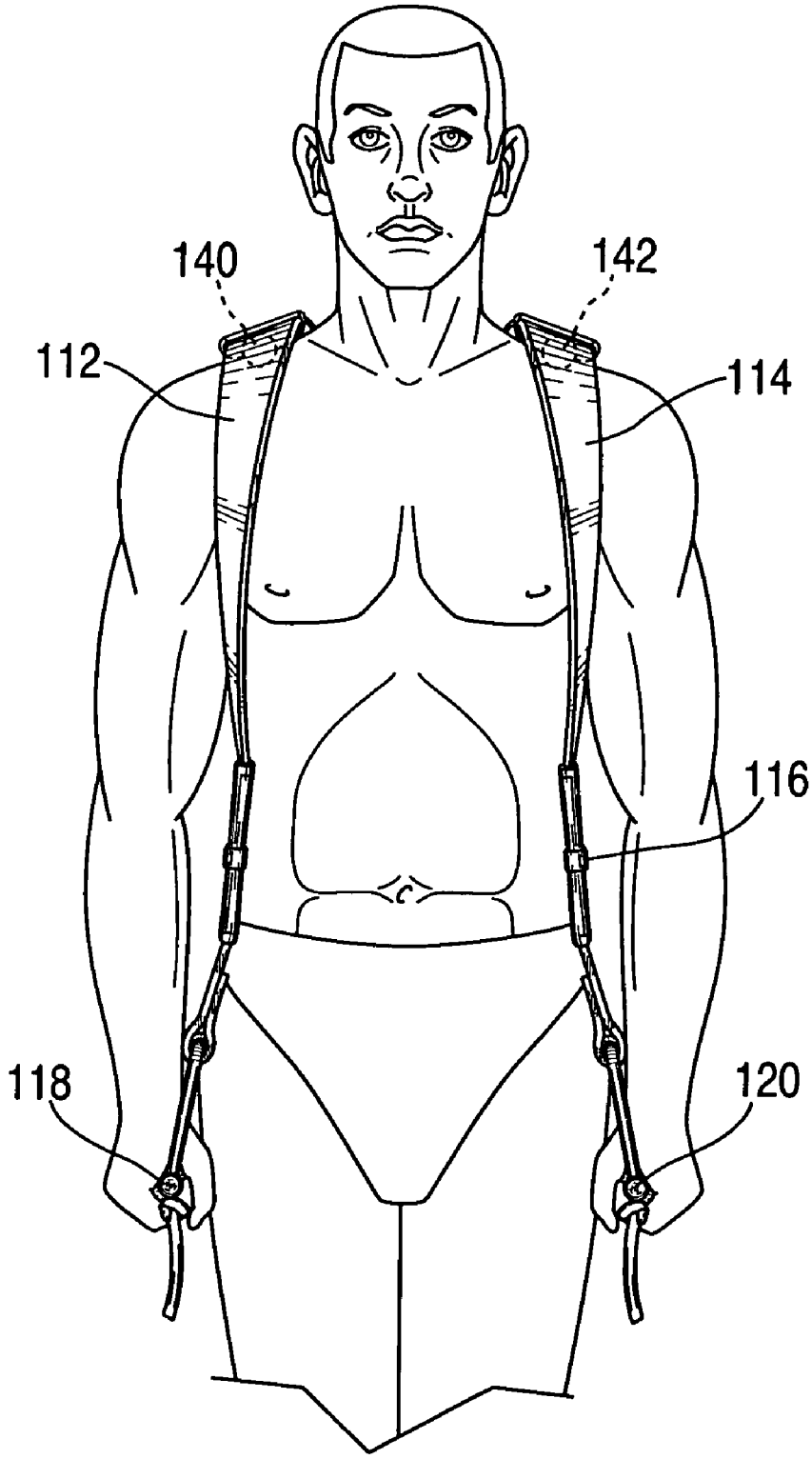
FIG. 3A is a view similar to FIG. 3 but illustrating the jacket of FIGS. 1A and 2A.

Turning now to FIGS. 1A-6A, a postural support and exercise jacket 110 according to the invention is similar to the jacket 10 described above with similar parts having similar reference numerals (increased by 100). The only significant difference in the jacket 110 as compared to the jacket 10 lies in the handles 118, 120. On each handle, one of the eyelets 118*b*, 120*b* is provided with an orthogonal threaded bore 118*d*, 120*d* and a set screw 118*e*, 120*e*. In this embodiment, the handle location id adjusted by releasing the set screw, moving the rope, and resetting the screw. Compare FIGS. 1A and 2A. The set screw is preferably set with an Allen wrench.

Another difference between the jacket 110 and the jacket 10 is the inclusion of two presser balls 140, 142 preferably made of wood. Each ball has a throughbore 140*a*, 142*a* and an adjustable strap 144, 146 which passes through the bore. The balls are thus removably attached to the shoulder straps and can be used with either jacket 10 or jacket 110. These presser balls are provided and are adjustably coupled to the shoulder straps to overlie a muscle "knot". More than two balls can be used, if desired. The purpose of the ball is to eradicate myofascial trigger points (contraction "knots") in tight muscles. There are two basic applications: a press and release technique (10-30 seconds of sustained pressure on the "knot"); and a press and stretch technique (sustained pressure on the "knot" in conjunction with muscle stretching).

Proper use of the jacket according to the invention provides decreased muscle tension in the neck, jaw, shoulders, and back, diminished discomfort (including stiffness, tightness, numbness, burning, headaches, jaw pain and dysfunction, etc.), improved postural alignment that is efficient, functional, and aesthetic, enhanced core stability for the relief of low back pain, increased abdominal muscle strength, increased back extensor muscle strength, decreased fatigue and improved mental state, enhanced performance in work, athletics, dance, etc.

Those skilled in the art will appreciate that the jacket is preferably provided in different sizes to fit different users. For example, the sizes small, medium, large and extra large are appropriate. Moreover, jackets according to the invention can be custom fitted to a user. In addition, the jacket could be incorporated into a variety of consumer products, such as backpacks, baby carriers, etc. so as to enable the wearer to perform the exercises during other activities.

There have been described and illustrated herein several embodiments of a postural support and exercise jacket. Other modifications may be made as will be apparent to those skilled in the art. For example although adjustment of the handles can be effected by a simple rope or rope and set screw assembly as discussed above, other handle adjustments means may be provided for lengthening, shortening and/or locking the handles at a desired height. In addition, the jacket may be used in association with other exercises. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A postural support and exercise jacket for a person, comprising:

a right shoulder strap which is receivable over the right shoulder of the person and a left shoulder strap which is receivable over the left shoulder of the person, wherein said shoulder straps each have a front portion terminating in a front end and a back portion terminating in a back end, which back portion is joined to said front portion via an intermediate portion which straddles the associated shoulder of the person, wherein said front portion of the right shoulder strap is positioned to extend downwardly from the right shoulder of the person to the right side of the person such that the front end thereof terminates generally adjacent to the waist of the person, said front portion of the left shoulder strap is positioned to extend downwardly from the left shoulder of the person to the left side of the person such that the front end thereof terminates generally adjacent to the waist of the person, and the back portion of each of said shoulder straps is positioned to cross the back of the person from the associated shoulder of the person to the opposite side of the person thereof, such that the back end of each of said shoulder straps terminate generally adjacent to the waist of the person, and wherein said back portions of said shoulder straps cross over each other and are coupled to each other at the point where they cross over;

a waist strap having a first end and a second end, both ends of each shoulder strap being coupled to said waist strap generally adjacent to an opposite end of said waist strap, said waist strap being dimensioned to extend around the back of the person with said ends thereof terminating adjacent to the sides of the person, wherein said front end of said right shoulder strap and said back end of said left shoulder strap are disposed generally adjacent to said first end of said waist strap and wherein said back end of said right shoulder strap and said front end of said left shoulder strap are disposed generally adjacent to said second end of said waist strap; and a single pair of depending handles, each being coupled adjacent to opposite ends of said waist strap.

2. A jacket according to claim 1, additionally including:

means for adjusting said handles as to their distance from said waist strap.

3. A jacket according to claim 2, further comprising:

a pair of depending straps coupled to said waist strap, said handles each being coupled to one of said depending straps.

4. A jacket according to claim 3, wherein:

said depending straps form lower loops, and said means for adjusting includes a pair of ropes and each handle is coupled to a depending strap by one of said pair of ropes.

5. A jacket according to claim 4, wherein:

each handle includes a gripping part and two opposite eyelets, each rope has two ends, each end extending through an eyelet and being knotted.

6. A jacket according to claim 1, further comprising:

at least one ball made of a hard material removably attached to one of said shoulder straps.

7. A jacket according to claim 1, wherein said jacket is made of a material which is able to withstand a substantial amount of stretching force.

8. A postural support and exercise jacket for a person, comprising:

a waist strap having a first and second end and which strap is dimensioned to extend around the back of the person with said ends thereof terminating adjacent to the sides of the person;

a single pair of shoulder straps having first and second ends each coupled to said waist strap generally adjacent to an opposite end of said waist strap, wherein said shoulder straps comprise a right shoulder strap which is receivable over the right shoulder of the person and a left shoulder strap which is receivable over the left shoulder of the person, wherein said shoulder straps each have a front portion terminating in a front end and a back portion terminating in a back end, which back portion is joined to said front portion via an intermediate portion which straddles the associated shoulder of the person, wherein said front portion of the right shoulder strap is positioned to extend downwardly from the right shoulder of the person to the right side of the person such that the front end thereof terminates generally adjacent to the waist of the person, said front portion of the left shoulder strap is positioned to extend downwardly from the left shoulder of the person to the left side of the person such that the front end thereof terminates generally adjacent to the waist of the person, and the back portion of each of said shoulder straps is positioned to cross the back of the person from the associated shoulder of the person to the opposite side of the person thereof, such that the back end of each of said shoulder straps terminate generally adjacent to the waist of the person, and wherein said back portions of said shoulder straps cross over each other at a point and are coupled to each other at said point and wherein said front end of said right shoulder strap and said back end of said left shoulder strap are disposed generally adjacent to said first end of said waist strap and wherein said back end of said right shoulder strap and said front end of said left shoulder strap are disposed generally adjacent to said second end of said waist strap;

a single pair of depending straps, each coupled adjacent to opposite ends of said waist strap; and a single pair of handles, each adjustably coupled to one of said depending straps in a manner whereby the distance of the handles from the waist strap can be adjusted.

9. A jacket according to claim 8, further comprising:

a pair of ropes, wherein said depending straps form loops and said handles are coupled to said depending straps by said ropes extending through said loops.

10. A jacket according to claim 9, wherein:

each handle includes at least one eyelet through which a respective rope passes and is knotted.

11. A jacket according to claim 8, further comprising:

a pair of balls made of hard material, each ball being removably coupled to a respective shoulder strap.

12. A jacket according to claim 11, wherein:

each ball is movable over at least a portion of a respective shoulder strap.

13. A jacket according to claim 12, wherein:

each ball has a throughbore with a strap extending therethrough.

14. A jacket according to claim 8, wherein said jacket is made of a material which is able to withstand a substantial amount of stretching force.

15. A postural support and exercise jacket for a person, comprising:

a right shoulder strap which is receivable over the right shoulder of the person and a left shoulder strap which is receivable over the left shoulder of the person, wherein said shoulders straps each have a front portion terminating in a first end and a back portion terminating in a second end, which back portion is joined to said front portion via an intermediate portion which straddles the associated shoulder of the person, wherein said front portion of the right shoulder strap is positioned to extend downwardly from the right shoulder of the person and terminates generally adjacent the right side of the person and said front portion of the left shoulder strap is positioned to extend downwardly from the left shoulder of the person and terminates generally adjacent the left side of the person, and the back portion of each of said shoulder straps is positioned to cross the back of the person from the associated shoulder of the person to generally adjacent the opposite side of the person thereof, and wherein said rear portions of said shoulder straps cross over each other;

a back strap having two ends, wherein at least one of said ends of each shoulder strap is coupled to said back strap generally adjacent to an opposite end of said back strap, said back strap being dimensioned to extend at least part of the way around the back of the person; and a single pair of depending handles, each extending downwardly from said back strap and dimensioned to permit positioning thereof adjacent to the sides of the person.

16. A jacket according to claim 15, wherein:

said depending handles are each coupled to a depending strap and each depending strap extends downwardly below said back strap.

17. A jacket according to claim 15, additionally including:

means for adjusting said handles as to their distance from said back strap.

18. A jacket according to claim 15, further comprising:

at least one ball made of hard material removably attached to one of said shoulder straps.

19. A jacket according to claim 15, wherein:

said rear portion of said shoulder straps are coupled to each other at the point where they cross over.

20. A jacket according to claim 15, wherein said jacket is made of a material which is able to withstand a substantial amount of stretching force.

21. A postural support and exercise jacket for a person, comprising:

a back strap having a first and second end, said back strap being dimensioned to extend at least part of the way around the back of the person;

a right shoulder strap which is receivable over the right shoulder of the person and a left shoulder strap which is receivable over the left shoulder of the person, wherein said shoulder straps have a front portion terminating in a first end and a back portion terminating in a second end, which back portion is joined to said front portion via an intermediate portion which straddles the associated shoulder of the person, wherein said front portion of the right shoulder strap is positioned to extend downwardly from the right shoulder of the person and terminates generally adjacent the right side of the person and said front portion of the left shoulder strap is positioned to extend downwardly from the left shoulder of the person and terminates generally adjacent the left side of the person, and the back portion of each of said shoulder straps is positioned to cross the back of the person from the associated shoulder of the person to generally adjacent the opposite side of the person thereof, and wherein said rear portions of said shoulder straps cross over each other, and wherein at least one of said ends of each shoulder strap is coupled to said back strap generally adjacent to an opposite end of said back strap; and a single pair of handles, each extending downwardly from said back strap and dimensioned to permit positioning thereof adjacent to the sides of the person, wherein each is adjustably coupled in a manner whereby the distance of the handles from the back strap can be adjusted.

22. A jacket according to claim 21, wherein:

said depending handles are each coupled to a depending strap and each depending strap extends downwardly below said back strap.

23. A jacket according to claim 21, wherein:

said rear portion of said shoulder straps are coupled to each other at said point where they cross over.

24. A jacket according to claim 21, further comprising:

a pair of balls made of a hard material, each ball being removably coupled to a respective shoulder strap.

25. A jacket according to claim 21, wherein said jacket is made of a material which is able to withstand a substantial amount of stretching force.

* * * * *